US005574471A

United States Patent [19]

Sureau

[11] Patent Number: 5,574,471

[45] Date of Patent: Nov. 12, 1996

[54] ELECTROMAGNETIC ENERGY SHIELD

[75] Inventor: Jean-Claude Sureau, Boston, Mass.

[73] Assignee: Radant Systems, Inc., Stow, Mass.

[21] Appl. No.: 690,816

[22] Filed: Jan. 11, 1985

Related U.S. Application Data

[63] Continuation of Ser. No. 415,260, Sep. 7, 1982, abandoned.

[51] Int. Cl.[6] ..... H01Q 15/02; H01Q 15/24

[52] U.S. Cl. ..... 343/909

[58] Field of Search ..... 343/754, 755, 343/756, 841, 908, 909, 700 MS, 911 R, 753

[56] References Cited

U.S. PATENT DOCUMENTS

| | | | |
|---|---|---|---|
| 3,708,796 | 1/1973 | Gilbert | 343/909 |
| 4,212,014 | 7/1980 | Chekroun | 343/909 |
| 4,266,203 | 5/1981 | Saudreau et al. | 343/756 |
| 4,297,708 | 10/1981 | Vidal | 343/754 |

*Primary Examiner*—Theodore M. Blum
*Attorney, Agent, or Firm*—Ernest V. Linek, Esq.

[57] ABSTRACT

A structure for selectively transmitting electromagnetic energy over a selected frequency range during a first operating mode and for substantially preventing the transmission of electromagnetic energy at any frequency during a second operating mode either by absorption or by reflection of such energy. The structure includes at least one shutter means comprising continuous and discontinuous elements and diode means interconnecting the discontinuous portions of the discontinuous element. The diode means are biased in a non-conductive direction during the first operating mode and are biased in a conductive direction during the second operating mode. The structure can further include filter means which include continuous and discontinuous elements arranged so as to be resonant over the selective frequency range during both operating modes. The filter means and the shutter means can be positioned at distances from each other of approximately one or more quarter wave lengths of the center frequency of the selective frequency range.

21 Claims, 3 Drawing Sheets

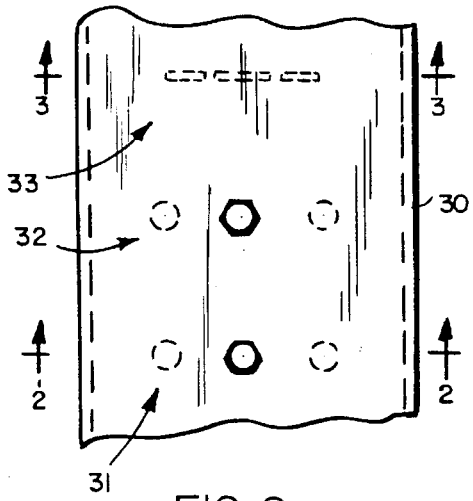
FIG. 8
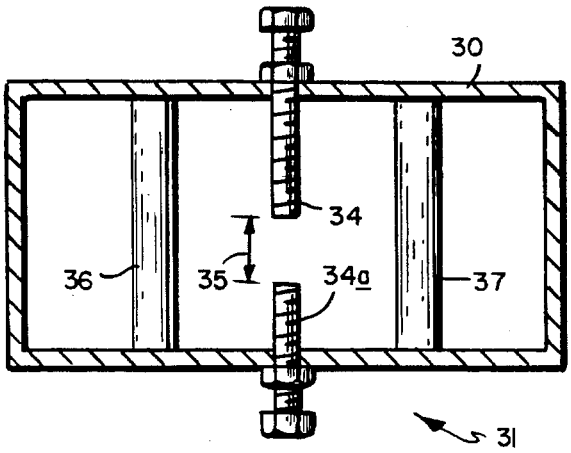
FIG. 9
FIG. 10
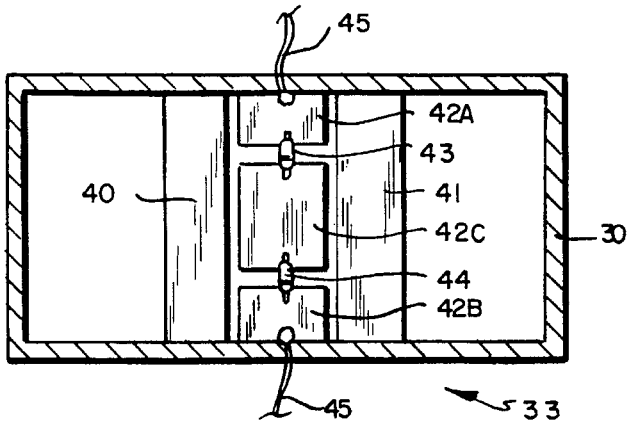
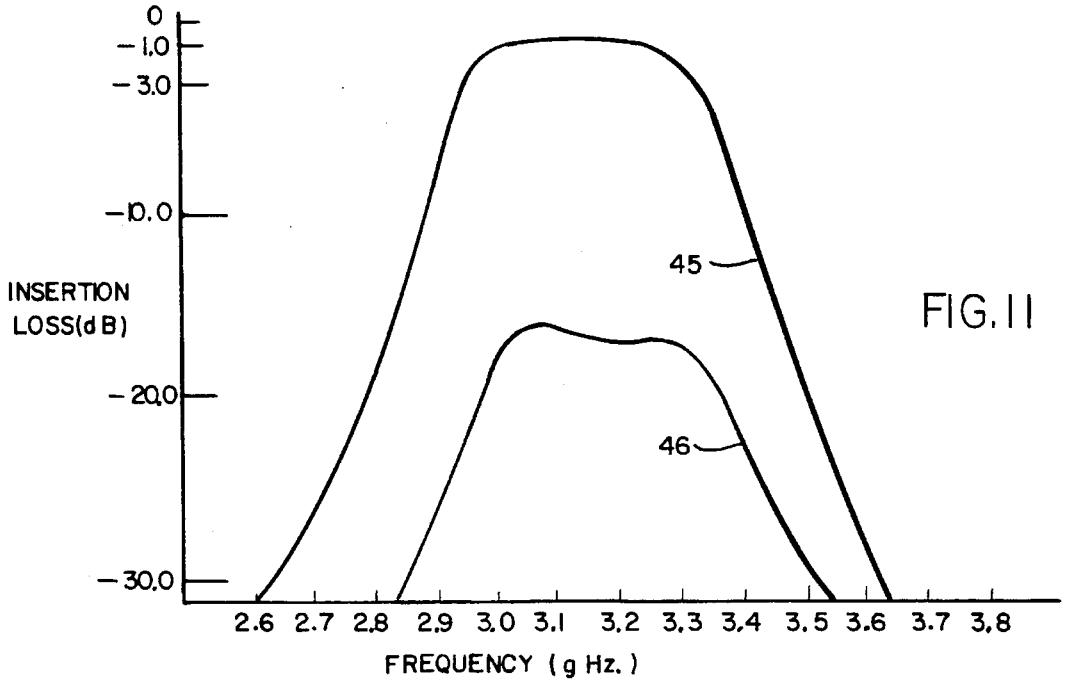
FIG. 11

ELECTROMAGNETIC ENERGY SHIELD

This application is a continuation of application Ser. No. 415,260, filed Sep. 7, 1982, abandoned.

INTRODUCTION

This invention relates generally to structures for selectively transmitting electromagnetic energy and, more particularly, to electronic circuit structures arranged so that at selected times the transmission of electromagnetic energy therethrough is permitted only in a selected frequency range, energy outside such range being essentially rejected, and at other selected times the transmission therethrough of energy in such selected frequency range is substantially reduced, while energy outside such range is still rejected. Such structures can be used, for example, as special radomes shielding microwave antennas and auxilliary equipment from externally incident energy.

BACKGROUND OF THE INVENTION

Radome structures are conventionally used to protect microwave antennas from the physical environment. It is also desirable to shield such equipment from externally incident electromagnetic energy which can adversely affect the electrical operating characteristics thereof. Ideally, such a shield during operation of the antenna equipment should be transparent to the energy in a selected frequency range handled by the antenna (the "in-band" frequency range) but should reject all frequencies outside such frequency range (the "out-of-band" frequency range). Further, when the antenna equipment is not operating, such a shield should reject electromagnetic energy over all frequencies of concern.

Radome shields having such characteristics have often been referred to as "shutter-type" radomes, the frequency shutter in effect being effectively "closed" to all frequencies during non-operation and the frequency shutter being effectively "opened" only to the desired operating frequency band during operation. Shutter-type radomes presently used in the art have consisted primarily of electro-mechanical devices which are relatively bulky and cumbersome to fabricate and use and which have the added disadvantage of being relatively slow in changing from one mode of operation to the other. It is desirable to develop simpler structures for such purpose which structures can provide relatively fast operation shifting from the "shutter open" to the "shutter closed" states.

BRIEF SUMMARY OF THE INVENTION

In accordance with the invention, a shutter type structure includes electronic means for providing a resonant structure which utilizes suitable diodes. In its "open" state the diode means are biased in such a manner as to provide a selected band-pass characteristic for the structure which permits the transmission therethrough of electromagnetic energy having frequencies within the selected passband, energy having frequencies outside the pass band being effectively rejected. During the "closed" state the diode means are biased in such a manner to radically modify the behavior of the structure so as to substantially reduce the transmission of energy within the selected pass band, energy outside the pass band still being effectively rejected.

Thus in one exemplary embodiment of the invention, a shutter-type radome shield comprises a plurality of substrates, each of which is separated by one-quarter of the wavelength ($\lambda/4$) of the center frequency of the selected in-band frequency range. At least one substrate contains an array of diodes together with an array of continuous wires so as to provide the desired bandpass characteristics, the diode array being used to create the desired shutter effect. The remaining one or more substrates may contain an array of diodes and an array of continuous wires if the structure is to operate as an energy absorbing structure, or may contain an array of continuous and discontinuous wires (with no diodes present) if the structure is to be energy reflective. At least one substrate which contains diodes is designated as an "in-board" array, the remaining substrates being designated as "out-board" arrays. When the diodes are reversed biased and the dimensions of the wire array are suitably selected, energy in the in-band frequency band can be transmitted through the shield. When the in-board diodes are sufficiently forward biased, substantially all frequencies of concern are prevented from being transmitted through the shield. The out-board diodes, if present, in an energy absorbent structure are only slightly forward biased and act as resistances to effectively absorb some of the power from electromagnetic energy which is "externally" incident on the shield. The out-board arrays which do not contain diodes act to reflect out of band externally incident energy.

The fabrication of such a shield can be readily performed and the structure can be effectively used with a conventional radome structure. Moreover, the conversion of the shield from the open to closed shutter modes can be performed in a relatively rapid fashion.

DESCRIPTION OF THE INVENTION

The invention can be described in more detail with the help of the accompanying drawings wherein FIG. 1 depicts a portion of an exemplary embodiment of the structure of the invention;

FIG. 8 depicts a plan view of a still further embodiment of the invention as used in an exemplary waveguide structure;

FIG. 9 depicts a view in section along lines 9—9 of a portion of the embodiment of FIG. 8;

FIG. 10 depicts a view in section, along lines 10—10 of another portion of the embodiment of FIG. 8; and FIG. 11 depicts curves of the operating characteristics of the embodiment of FIGS. 8–10.

Figure 1:
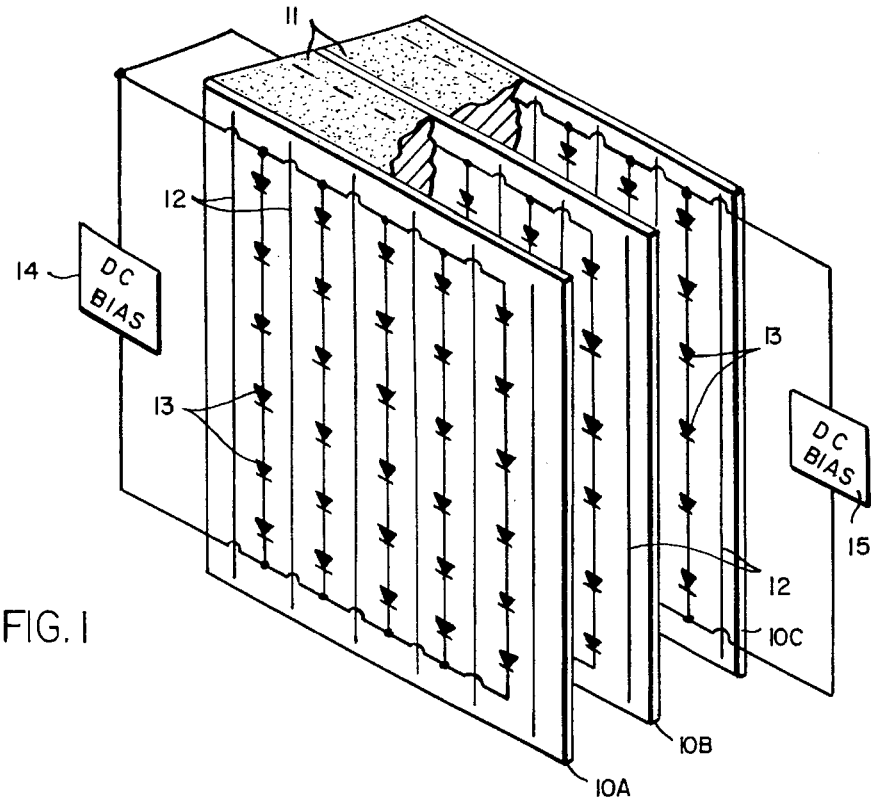

As can be seen in the portion of a particular embodiment of the invention shown in FIG. 1 a plurality of relatively thin dielectric substrates 10A, 10B and 10C are separated by suitable low density foam or non-metallic honeycomb structures 11. Each substrate panel carries a plurality of parallel continuous metallic wires 12. In addition each panel carries a diode array 13, formed as conductive paths each of which include a plurality of series connected diodes, the paths being interconnected and positioned between and in parallel with the continuous wires as shown. Panels 10A and 10B can be referred to as "out-board" panels, while panel 10C can be referred to as an "in-board" panel.

The series connected diodes on out-board panels 10A and 10B are commonly connected to a first DC bias power supply 14, while the series connected diodes on in-board panel 10C are commonly connected to a second DC bias power supply 15. The power supplies can be rapidly switched from one polarity to the other in a conventional manner so as to reverse bias or to forward bias the diodes as desired.

During the operating mode, i.e., when it is desired that electromagnetic energy which is incident upon the panels and which lies in a selected frequency range, be transmitted through the panel and all other frequencies be prevented from such transmission, all of the diodes are reverse biased. In such case, the wire grids containing the diodes effectively operate as discontinuous wire grids. Such operation can be best understood from an examination of the electrical equivalent circuit shown in FIG. 2.

Figure 2:
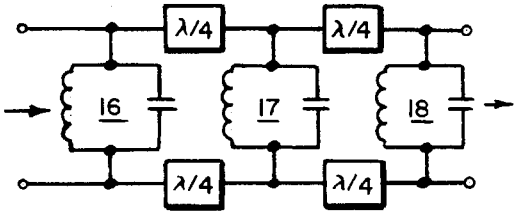
FIG. 2 depicts an equivalent circuit representing the operation of the embodiment of FIG. 1 in one mode of operation thereof.

The reversed diode arrays (equivalent to capacitors) and continuous wire grids (equivalent to inductors) of both the out-board and in-board panels each effectively form a tuned circuit, as shown by tuned circuits 16 and 17 corresponding to out-board panels 10A and 10B and tuned circuit 18 corresponding to in-board panel 10C. The tuned circuits each act as parallel resonant circuits the center frequency of which is equal to the center frequency of the in-band frequency range and the bandwidth of which is made to correspond to that of the in-band frequency range. The selection of the dimensions of the wire grids, formed by continuous wires 12 in each panel determine the pass bands of the tuned circuits 16–18. The dimensions of the discontinuous wire grids (i.e. containing the diodes) are selected to resonate the continuous wires, taking into account the diode capacitances. Each of the tuned circuits is separated, as in a transmission line, by one quarter wave length ($\lambda/4$) as depicted in FIG. 2. Thus, during the operating mode all frequencies in the pass band of the tuned circuits are transmitted through the structure shown in FIG. 1 (as depicted diagrammatically by the arrows in FIG. 2). The use of multiple panels permits the band pass characteristics of the overall structure to be suitably shaped.

Although the diodes are reversed biased in the embodiment discussed above, the diodes may be of the zero-bias type so that instead of reverse biasing them the power supply may be simplified to provide no bias voltage during the operating mode so as to effectively achieve the same operation.

Figure 3:
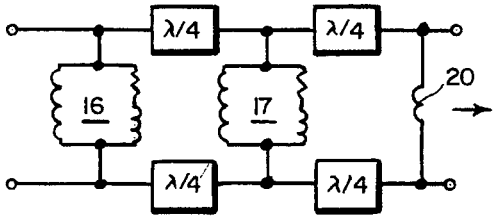
FIG. 3 depicts an equivalent circuit representing the operation of the embodiment of FIG. 1 in the alternative mode of operation thereof.
Figure 3A:
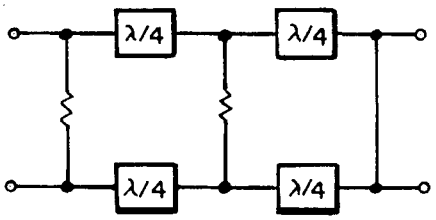
FIG. 3A depicts an ideal equivalent circuit corresponding to FIG. 3.

FIG. 3 depicts the equivalent circuits of FIG. 2 during the non-operating mode, i.e., when the transmitting and/or receiving antenna is non-operative. In such mode the diodes in the in-board panel 10C are biased so as to provide a first forward bias current while the diodes of the out-board panels 10A and 10B are biased so as to provide a second forward bias current. The in-board forward bias current is selected to be sufficiently large to provide full conduction in the forward direction so that the diodes effectively appear as short-circuits (a residual wire inductance tends to remain as shown by the relatively small inductance 20 shown in FIG. 3). The out-board forward bias current is selected to be much lower than that of the in-board diodes, the slight forward biasing causing the diodes to behave predominantly as resistances. Such resistances thereby tend to absorb some of the power incident on the outboard panels. FIG. 3A represents an ideal condition desired during the forward biasing mode, wherein the out-board circuits are pure resistances and the in-board circuit is a short circuit. In practice, however, such ideal conditions do not occur and the equivalent circuit tends to appear as shown in FIG. 3. Thus, while the incident energy is not completely prevented from being transmitted through the structure, the amount transmitted is substantially reduced. The amount of power absorbed can be controlled by the number of the out-board panels used. Normally, only a single in-board panel is required for reflective type shielding, although more than one may be used in some applications.

Figure 4:
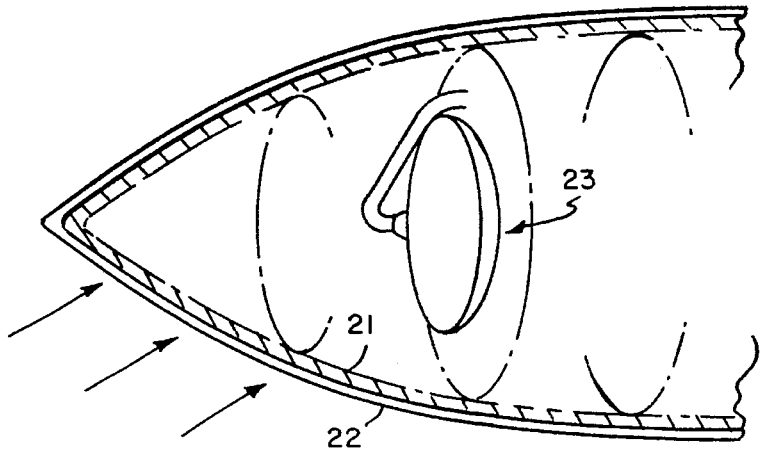
FIG. 4 depicts in diagrammatic form a radome structure which shows one manner in which an embodiment of the invention can be used.

Panels of the type shown in FIG. 1 can be shaped in such a manner as to conform to the shape of a radome structure as shown in FIG. 4 wherein the shield structure 21 of the invention conforms to the substantially conical (ogive) shape of the radome structure 22 which encloses antenna structure 23. Alternatively, the radome and shield structures can be integrally formed during manufacture.

Figure 5:
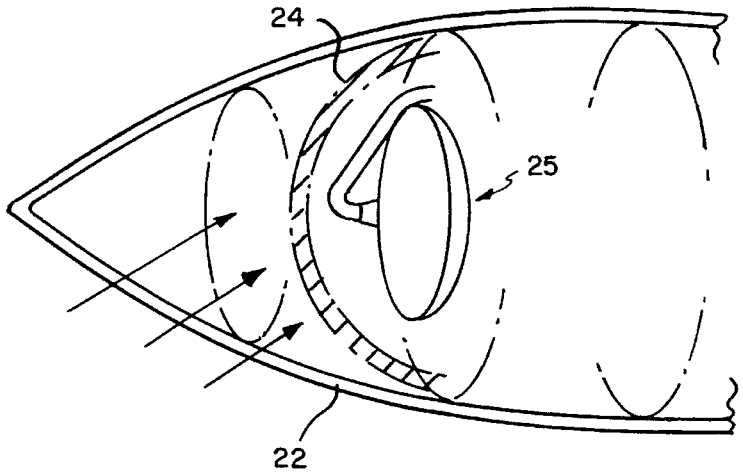
FIG. 5 depicts in diagrammatic form a radome structure which shows another way in which an embodiment of the invention can be used.

As a further alternative the shield structure can be shaped independently of the shape of the radome enclosure and formed separately therefrom as depicted in FIG. 5 wherein the shield forms an individual hemispherical cover 24 for antenna 25 within the conical radome enclosure 22.

Figure 6:
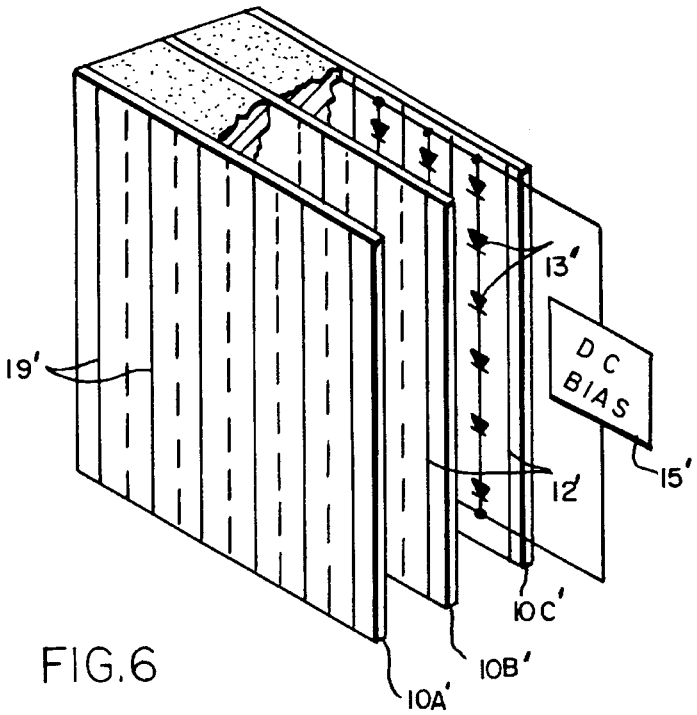
FIG. 6 depicts an alternative embodiment of the invention shown in FIG. 1.

An alternative embodiment of the structure depicted in FIG. 1 is shown in FIG. 6 in which an in-board panel 10C' of the type used in FIG. 1 (using continuous wires 12', diodes 13' and bias supply 15') is also utilized. In the alternative embodiment out-board panels 10A and 10B each use a plurality of continuous wires 12' and a plurality of dis-continuous wires 19', the diodes shown in panels 10A and 10B of FIG. 1 being eliminated to provide the dis-continuities. During the operating mode, the dimensions of the dis-continuous wires are selected to resonate with the continuous wires, as in FIG. 1, to provide appropriate resonant circuits, as before. During the non-operating mode the continuous and discontinuous wire grid arrays of FIG. 6 continue to resonate and, consequently, do not absorb power as in FIG. 1. The overall structure then effectively operates as a reflective energy structure wherein a substantial amount of incident energy impinging thereon is effectively reflected back from the structure so that the amount transmitted therethrough is substantially reduced.

Figure 7:
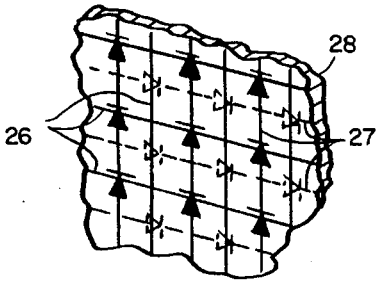
FIGS. 7 and 7A depict a portion of a substrate which represents a further alternative embodiment of the invention.
Figure 7A:
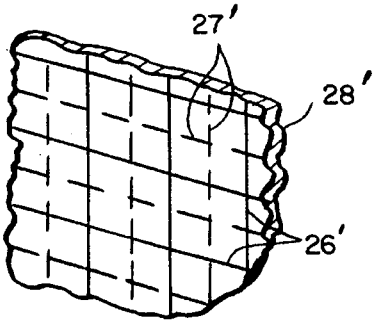

The embodiments of FIGS. 1 and 6 are effective for electromagnetic energy which has a polarization substantially parallel to both the continuous wire paths and the diode array paths or the dis-continuous wire paths shown therein. If it is desired that the performance characteristic of the shield be effectively independent of polarization, each panel can be arranged to contain orthogonal grids of continuous wire and diode array paths, as shown in FIG. 7, or of continuous and dis-continuous wire paths, as shown in FIG. 7A. The orthogonal continuous wires 26 and the orthogonal diode array 27 or the orthogonal continuous wires 26' and orthogonal dis-continuous wires 27' can be suitably positioned, for example, on the surfaces of the substrates 28 and 28', respectively, which are opposite to the surface on which wires 12 and diodes 13 or wires 12' and wires 19' are positioned in FIGS. 1 and 6.

The dimensions and spacings of the wires will depend upon the application in which the above configurations are to be used, i.e. on the frequencies and band widths of interest. The bias currents required will depend on the diodes which are selected for use. Such values can generally be empirically determined by those in the art using conventional techniques so that such structures can be readily fabricated for the applications desired.

While the invention is most effectively embodied in panel form as discussed above for use in radome structures, the invention can also be used in a different structural environment such as the waveguide structure depicted in FIGS. 8–10.

As can be seen therein, as waveguide 30 has first and second filter elements 31 and 32, respectively, and a shutter element 33 placed therein at selected regions thereof separated by a quarter-wavelength of the center frequency of a selected in-band frequency range. Each of the filter elements includes a pair of oppositely disposed upper and lower vertically adjustable metallic posts 34 and 34A, respectively, as best seen in FIG. 9, the spacing 35 therebetween being selected to provide a desired capacitive effect, as discussed in more detail below. A further pair of fixed posts 36 and 37 (see FIG. 9) extend between the upper and lower inner surfaces of the waveguide 30 and effectively act as inductive elements. The combination of adjustable posts 34, 34A and fixed posts 36 and 37 form an equivalent parallel LC circuit which is resonant over a selected frequency band at a selected center frequency.

The shutter element 33 includes a pair of outer rectangular metallic strips 40 and 41 extending between the upper and lower inner surface of waveguide 30, as best seen in FIG. 10. A further discontinuous metallic strip 42 is effectively formed of upper and lower portions 42A and 42B and center portion 42C which portions are interconnected as shown by diodes 43 and 44. Suitable leads 45 are used to connect the diodes to a d.c. bias supply (not shown).

When the adjustable posts 34 and 34A are suitably positioned relative to each other in each filter element, the filter elements are effectively resonant over a selected band width having a selected center frequency. When the diodes are reversed biased (operating in effect as open circuits) the dimensions and spacings of the metallic strips 40, 41 and 42 are arranged to resonate over the same selected bandwidth and at the same selected center frequency. Under such conditions electromagnetic energy over such pass band which enters waveguide 30 is transmitted through the waveguide with substantially little or no loss.

When the diodes are sufficiently forward biased (operating in effect as short circuits) the portions 42A, 42B and 42C are interconnected and the shutter element as a whole tends to substantially reduce the electromagnetic energy which can be transmitted through the waveguide. Such energy will accordingly be reflected back from shutter element 33.

In a specific exemplary structure based on the embodiment of FIGS. 8–10, the dimensions are as follows:

Waveguide

Inner Height=1.34"

Inner Width=2.84"

Filter Elements

Posts 36 and 37—Diameter=0.250"

Posts 34 and 34A—Diameter=0.132"

Post 34—Length from top of waveguide=0.65"

Post 34A—Length from bottom of waveguide=0.3555"

Spacing between=0.3555"

Shutter Element

Strips 40 and 41—Width=8.9 mm.

Strips 42A, 41B, 42C—Width=12.7 mm.

Strip 42C—Height=12.7 mm.

Vertical spacing between strips 40 and 42 and strips 41 and 42=0.75 mm.

Horizontal spacing between strips 42A and 42C and strips 42B and 42C=2.0 mm.

Zero Bias Diodes (Typical)

"Reverse" capacitance=0.2 pfd.

Series resistance—1.0 ohm (at 100 mA)

Forward Bias Current=20 mA

Reverse Bias Voltage=0 volt

The above dimensions provide a center resonance frequency of 3.15 gigahertz (GHz). Using "zero-bias" diodes, the reverse bias voltage was 0 volts. The frequency response thereof in the "open" shutter mode (zero biased diodes) is shown by curve 45 in FIG. 11. A relatively small insertion loss of about 1.0 dB exists over the flat portion of the response, the response being down by about 3.0 dB over a pass band from about 2.9–3.4 GHz.

When the diodes are forward biased at a sufficient voltage to provide a forward biased current of about 20 milliamperes (mA), the insertion loss increases and the response drops by approximately 15 dB over a pass band from about 3.0 GHz to about 3.3 GHz and even more substantially outside such pass band as shown by curve 46 in FIG. 11. Thus the transmission of electromagnetic energy is reduced considerably in the "closed" shutter mode.

While specific embodiments of the invention are described above with reference to FIGS. 1–11, modifications to such embodiments will occur to those in the art within the spirit and scope of the invention. For example, while the embodiments of FIGS. 1 and 8 show the use of filter elements in the form of out-board panels 10A and 10B and in the form of elements 31 and 32, respectively, in some applications it may be sufficient to use only a single "shutter" element, such as the in-board panel 10C of FIG. 1 or the element 33 of FIGS. 8 and 10. The single shutter member operates so as to provide filtering action when the diodes thereof are non-conductive and to provide an effective "closed" shutter when the diodes are forward biased so as to provide full conduction. In a still further embodiment a plurality of shutter elements may be used, without the use of filter elements e.g. a plurality of in-board panels all operated in the manner of in-board panel 10C of FIG. 1 or a plurality of shutter elements in a waveguide all operating as shutter element 33 of FIGS. 8 and 10. Other combinations of, and embodiments of, such filter and shutter elements may also occur to those in the art in accordance with the invention. Hence, the invention is not to be construed as limited to the particular embodiments shown and described herein except as defined by the appended claims.

What is claimed is:

1. A structure for selectively transmitting electromagnetic energy, said structure comprising at least one shutter means being mounted in said structure and including a substrate, at least one surface of which includes at least one continuous conductive element extending in a selected direction along substantially the entire length of said surface; and at least one discontinuous element having separated conductive portions and extending in said selected direction along substantially the entire length of said surface; and at least one diode means interconnecting the separated portions of said at least one discontinuous element;

means for biasing said at least one diode means in a non-conductive direction during a first operating mode so that said shutter means is substantially resonant to electromagnetic energy incident thereon within a selected frequency range so as to permit the substantial transmission of said incident energy within said selected frequency range through said structure and for biasing said at least one diode means in a conductive direction during a second operating mode so that said shutter means substantially prevents the transmission of electromagnetic energy through said structure within and outside of said selected frequency range.

2. A structure for selectively transmitting electromagnetic energy, said structure comprising at least one resonating means being mounted on a panel surface within said structure and including a plurality of continuous conductive elements extending in a selected direction along substantially the entire length of said surface and a plurality of discontinuous elements having separated conductive portions and extending in said selected direction along substantially the entire length of said surface, one or more diode means interconnecting said separated portions of said resonating means;

means for biasing said one or more diode means in a non-conductive direction during a first operating mode so that said resonating means is resonant over a selected frequency range whereby electromagnetic energy within said selected frequency range which is incident on said structure is substantially transmitted through said structure; and said biasing means for biasing said one or more diode means in a conductive direction during a second operating mode so that said resonating means becomes non-resonant whereby said incident electromagnetic energy within and outside said selected frequency range is substantially prevented from being transmitted through said structure.

3. A structure in accordance with claim 2 and further including at least one filter means including resonating elements which are resonant over said selected frequency range, said at least one filter means being mounted in said structure at a distance from said at least one resonating means which is approximately one or more quarter wavelengths at the center frequency of said selected frequency range.

4. A structure in accordance with claim 3 wherein said at least one filter means includes continuous elements each forming a continuous conductive path and discontinuous elements each comprising a plurality of separated portions and forming a non-conductive path, said continuous elements and discontinuous elements being arranged to be resonant over said selected frequency range.

5. A structure in accordance with claim 4 wherein said at least one filter means includes further diode means interconnecting the discontinuous portions of said discontinuous elements; and further biasing means for biasing said further diode means in a non-conductive direction during said first operating mode whereby said continuous and discontinuous elements are resonant over said selected frequency range; and said further biasing means for biasing said further diode means in a conductive direction during said second operating mode, the level of said biasing being such that said filter means are substantially resistive and provide for absorption of at least a portion of said incident electromagnetic energy during said second operating mode.

6. A structure in accordance with claim 4 wherein the continuous and discontinuous resonating elements of said at least one filter means are resonant over said selected frequency range during said first and said second operating modes, said incident electromagnetic energy being substantially reflected from said structure during said second operating mode.

7. A shielding structure for selectively transmitting electromagnetic energy, said structure comprising at least one in-board panel means being positioned in said structure and including a first substrate a plurality of parallel continuous conductive elements applied to a first surface of said first substrate each of said continuous conductive elements extending in a selected direction along substantially the entire length of said first surface;

a plurality of parallel discontinuous conductive elements applied to the first surface of said first substrate in parallel with and intermediate said continuous conductive element each of said discontinuous conductive elements having separated portions extending in a selected direction along substantially the entire length of said first surface;

a plurality of first diode means interconnecting the separated portions of said discontinuous conductive elements; and first biasing means for biasing said first diode means in a non-conductive direction during a first operating mode and for biasing said first diode means at a first bias level in a conductive direction during a second operating mode;

at least one out-board panel means being positioned in said structure adjacent to said in-board panel means and including a second substrate;

a plurality of parallel continuous conductive elements applied to a first surface of said second substrate each of said continuous conductive elements extending in a selected direction along substantially the entire length of said first surface; and a plurality of parallel discontinuous conductive elements applied to the first surface of said second substrate in parallel with and intermediate said conductive elements each of said discontinuous conductive elements having separated portions extending in a selected direction along substantially the entire length of said first surface;

the continuous and discontinuous conductive elements on said in-board and said out-board panel means being resonant over a selected frequency range during said first operating mode so as to permit the transmission of electromagnetic energy within said selected frequency range during said first operating mode; and the continuous and discontinuous conductive elements of at least said in-board panel means being non-resonant during said second operating mode whereby the transmission of electromagnetic energy within said selected frequency range is substantially prevented, the transmission of electromagnetic energy outside said selected frequency range being substantially prevented during both said first and second operating modes.

8. A shielding structure in accordance with claim 7 wherein said out-board panel means further includes a plurality of second diode means all having the same polarity interconnecting the separated portions of said discontinuous conductive elements on said second substrate; and second biasing means for biasing said second diode means in a non-conductive direction during said first operating mode and for biasing said second diode means in a conductive direction at a second bias level during said second operating mode whereby the conductive elements on said out-board panel means are substantially resistive during said second operating mode so as to absorb at least a portion of said electromagnetic energy.

9. A shielding structure in accordance with claim 7 whereby the conductive elements of said out-board panel means remain resonant over said selected frequency range during said second operating mode and said electromagnetic energy is substantially reflected from said shielding structure during said second operating mode.

10. A shielding structure in accordance with claims 7, 8 or 9 wherein said at least one out-board panel and said at least one in-board panel are separated by approximately one or more quarter wavelengths of the center frequency of said selected frequency range.

11. A shielding structure in accordance with claim 10 and further including support means positioned between said at least one out-board panel and said at least one in-board panel.

12. A shielding structure in accordance with claim 11 wherein said support means is made of a low density foam material.

13. A shielding structure in accordance with claim 11 wherein said support means is a non-metallic honeycomb structure.

14. A shielding structure in accordance with claims 7, 8 or 9 wherein said at least one in-board panel further includes a further plurality of parallel continuous conductive elements applied to a second surface of said first substrate in an orthogonal direction relative to the continuous conductive elements applied to said first surface thereof, each of said further continuous conductive elements extending in said orthogonal direction along substantially the entire length of said second surface;

a further plurality of parallel discontinuous conductive elements applied to said second surface and parallel with and intermediate said further plurality of parallel continuous conductive elements, each of said further discontinuous conductive elements having separated portions and extending in said orthogonal direction along substantially the entire length of said second surface; and a plurality of further diode means interconnecting the separated portions of said further plurality of discontinuous conductive elements, said first biasing means further biasing said further diode means in a non-conductive direction during said first operating mode and further biasing said further diode means at said first bias level in a conductive direction during said second operating mode.

15. A structure for selectively transmitting electromagnetic energy through a waveguide, said structure comprising at least one shutter means being mounted in said waveguide and including at least one continuous conductive element extending in a selected direction substantially the entire distance from a first surface to a second surface of said waveguide;

at least one discontinuous element having separated conductive portions and extending in said selected direction from said first surface to said second surface of said waveguide;

at least one diode means interconnecting the separated portions of said at least one discontinuous conductive element; and means for biasing said at least one diode means in a non-conductive direction during a first operating mode so that such shutter means is substantially resonant to electromagnetic energy incident thereon within a selected frequency range so as to permit the substantial transmission of said incident energy within said selective frequency range through said waveguide and for biasing said at least one diode means in a conductive direction during a second operating mode so that such shutter means substantially prevents the transmission of electromagnetic energy through said waveguides within and outside of said selected frequency range.

16. A structure in accordance with claim 15 wherein said structure further includes at least one filter means being mounted in said waveguide and including at least one adjustable conductive element and at least one fixed conductive element, said adjustable conductive element being adjusted to operate in combination with said at least one fixed conductive element so that such filter means is substantially resonant to electromagnetic energy incident thereon within said selective frequency range during said first and second operating modes.

17. A structure in accordance with claims 15 or 16 wherein the separated portion of said discontinuous conductive element of said shutter means comprise first and second conductive sheets attached to the upper and lower surfaces of said waveguides, respectively, and projecting from said respective surfaces and a third conductive sheet positioned between and aligned with said first and second sheets, said diode means including at least two diode means one of which is attached to said first and third sheets and the other which is attached to said second and third sheets; and wherein said at least one continuous conductive element includes a first continuous conductive sheet mounted so as to continuously extend between the upper and lower surfaces of said waveguide adjacent one side of said discontinuous element and a second continuous conductive sheet mounted so as to continuously extend between the upper and lower surfaces of said waveguide adjacent the other side of said discontinuous element.

18. A structure in accordance with claim 17 wherein the dimensions of the separated portions of said discontinuous element and of said continuous element are selected so that said shutter means is substantially resonant to incident electromagnetic energy within said selected frequency range during said first operating mode.

19. A structure in accordance with claim 16 wherein said at least one adjustable conductive element comprises a first cylindrical means projecting downwardly from the upper surface of said waveguide and a second cylindrical means projecting upwardly from the lower surface of said waveguide in alignment with and opposite to said first cylindrical means, the distance between the first and second projecting cylindrical means being adjustable; and third and fourth cylindrical means extending between the upper and lower surfaces of said waveguide and positioned adjacent said first and second cylindrical means on either side thereof, respectively.

20. A structure in accordance with claim 19 wherein the dimensions of said first, second, third and fourth cylindrical means and the spacing between said first and second cylindrical means are selected so that said at least one filter means is substantially resonant to incident electromagnetic energy within said selected frequency range during said first and second operating modes.

21. A structure in accordance with claims 19 or 20 wherein said at least one filter means includes two filter means, said two filter means and said shutter means being positioned in said waveguide at distances from each other which are substantially equal to one or more quarter wavelengths of the center frequency of said selected frequency range.

* * * * *